US008233657B2

(12) United States Patent
Kaiya et al.

(10) Patent No.: US 8,233,657 B2
(45) Date of Patent: Jul. 31, 2012

(54) SPEAKER

(75) Inventors: Teruaki Kaiya, Tendo (JP); Daisuke Itoh, Tendo (JP); Kenta Fujimoto, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 600 days.

(21) Appl. No.: 12/440,982

(22) PCT Filed: Nov. 17, 2006

(86) PCT No.: PCT/JP2006/323027

§ 371 (c)(1),
(2), (4) Date: Mar. 12, 2009

(87) PCT Pub. No.: WO2008/059596

PCT Pub. Date: May 22, 2008

(65) Prior Publication Data

US 2010/0086169 A1 Apr. 8, 2010

(51) Int. Cl.
*H04R 11/02* (2006.01)

(52) U.S. Cl. ..... 381/401

(58) Field of Classification Search ..... 381/401
See application file for complete search history.

(56) References Cited

U.S. PATENT DOCUMENTS

| | | | | |
|---|---|---|---|---|
| 5,757,945 | A * | 5/1998 | Sakamoto | 381/400 |
| 6,263,084 | B1 * | 7/2001 | Cressman et al. | 381/164 |
| 6,421,449 | B1 * | 7/2002 | Hasegawa et al. | 381/401 |
| 7,146,020 | B2 * | 12/2006 | Peng | 381/409 |
| 7,940,950 | B2 * | 5/2011 | Shim | 381/393 |
| 2005/0141746 | A1 | 6/2005 | Kobayashi et al. | |
| 2007/0025586 | A1 * | 2/2007 | Young | 381/410 |
| 2007/0183620 | A1 * | 8/2007 | Stiles et al. | 381/401 |

FOREIGN PATENT DOCUMENTS

| | | | |
|---|---|---|---|
| JP | 6-49221 | U | 7/1994 |
| JP | 2004-312599 | A | 11/2004 |
| JP | 2005-505982 | A | 2/2005 |
| JP | 2005-191746 | A | 7/2005 |
| WO | 03/032505 | A2 | 4/2003 |

* cited by examiner

*Primary Examiner* — Charles Garber
*Assistant Examiner* — Andre' C Stevenson
(74) *Attorney, Agent, or Firm* — Sughrue Mion, PLLC

(57) ABSTRACT

There is provided a speaker allowing an air in a space between a diaphragm and a frame not to leak outside, and allowing connecting wires electrically connected to the voice coil to be guided out to an outside. A speaker I includes: a frame 4; a magnetic circuit unit 2; a vibrating unit 3; and a wiring structure unit 5. A hole 28 is formed on the frame 4. The magnetic circuit unit 2 is attached to the frame 4. The vibrating unit 3 is received in the frame 4, and includes diaphragms 14, 15 vibrated by the magnetic circuit unit 2. An air in a space surrounded by the diaphragms 14, 15 and the frame 4 is sealed. The wiring structure unit 5 includes a tube member 38, into which lead wires 37 are inserted. The tube member 38 is pressed into a hole 28, and guides the lead wires 37 to an outside of the space.

19 Claims, 3 Drawing Sheets

SPEAKER

TECHNICAL FIELD

This invention relates to a speaker for generating sound by, for example, vibrating a diaphragm with a supply of voice currents.

BACK GROUND ART

Conventionally, various speakers (for example, Patent Document 1) are mounted on a vehicle of a moving object. The speaker disclosed in Patent Document 1 includes: a frame; a diaphragm received in the frame; and a magnetic circuit unit attached to the frame, and generating sound by vibrating the vibrating unit.

The vibrating unit includes: a voice coil into which the voice currents are supplied; and a diaphragm attached to the voice coil. The magnetic circuit unit includes a permanent magnet, and the voice coil is positioned in a magnetic gap of the permanent magnet.

In the speaker having the above described configuration, by supplying voice currents to the voice coil, electromagnetic force (Lorentz force) acts on the voice coil to vibrate the diaphragm and to generate sound corresponding to the voice currents.

Further, in the speaker, for supplying the voice currents to the voice coil, lead wires as connecting wires are wired as described below. While a part of the lead wires are fixed between the frame and a retainer projected toward an inside of the frame, the voice coil and the lead wires electrically connected thereto via tinsel wires are guided an outside of the frame (outside of the speaker) via a hole penetrating the frame.

[Patent Document 1] Japanese published patent application No. 2005-505982

DISCLOSURE OF THE INVENTION

Problem to be Solved by the Invention

As the speaker mounted on a vehicle, a so-called air suspension speaker having the diaphragm and a drive cone for transmitting a vibration of the voice coil is suggested. Objects of the sir suspension speaker are an improvement of reproduced sound quality and a longer operating life by sealing a space between the diaphragm and the frame. When the wiring structure unit of the lead wires described above and disclosed in Patent Document 1 is applied to the air suspension speaker, of course, it is necessary to bore a hole on the frame to pass the retainer and the lead wires. Then, a space surrounded by the drive cone, the diaphragm, and the frame communicates with the outside via the hole so that an air in the sealed space cannot be compressed or expanded. Namely, elastic force owing to the expanded or compressed air (referred to as air spring) is reduced, and the air spring does not sufficiently act on the diaphragm. Resultingly, an abnormal behavior such that the diaphragm operates in amplitude larger than desired amplitude may occur. Further, it may be difficult to vibrate stably the diaphragm in large amplitude for a long time. Further, by the air moves in and out through the hole communicating with the outside, abnormal noise occurs to reduce acoustic characteristics. Therefore, in the so-called air suspension speaker described above, there is a problem to guide the lead wires for supplying the voice currents to the voice coil to the outside while the air in the sealed space is prevented from leaking to the outside.

Accordingly, an object of the present invention is to provide a speaker which allows connecting wires electrically connected to the voice coil to be guided to the outside while the air in the space surrounded by the drive cone, the diaphragm and the frame is prevented from leaking to the outside.

Means for Solving Problem

For attaining the object, according to claim 1 of the present invention, there is provided a speaker comprising:

a frame;

a magnetic circuit unit supported by the frame;

a voice coil received in the frame, and to which voice currents are supplied;

a diaphragm connected to the frame; and a drive cone for transmitting a vibration of the voice coil to the diaphragm, wherein the frame has a flange projecting from an inner wall thereof, wherein the drive cone is connected to the flange, wherein a sealed space surrounded by the frame, the diaphragm, and the drive cone is provided, wherein connecting wires electrically connected to the voice coil are inserted into a hole formed on the flange, and wherein a tube member into which the connecting lines are inserted is disposed into the hole.

BRIEF DESCRIPTION OF DRAWINGS

FIG. 2 A front view showing the speaker shown in FIG. 1 without a diaphragm, a center cap, and the like.

EXPLANATIONS OF LETTERS OR NUMERALS

Figure 1:
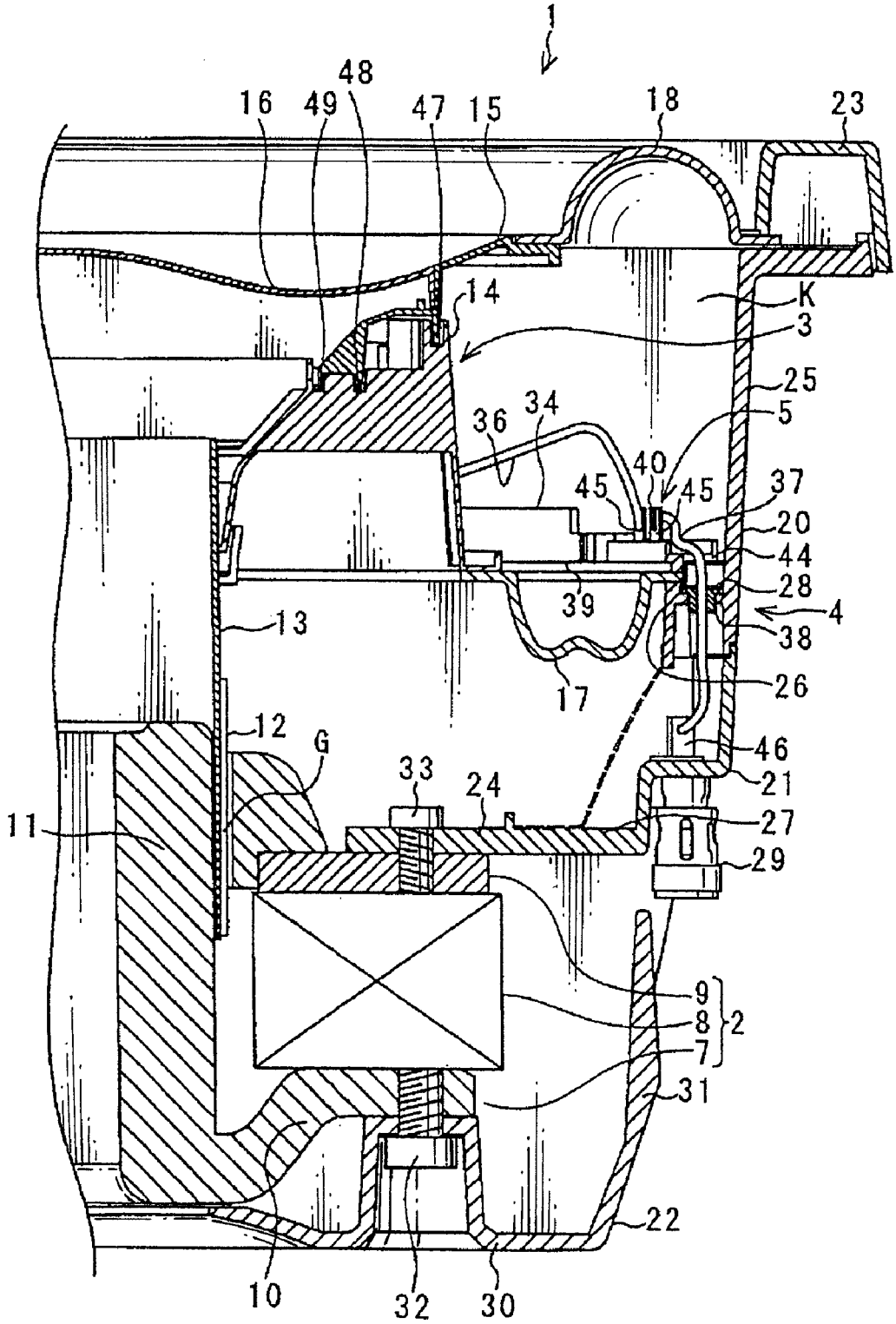
FIG. 1 A sectional view showing a speaker according to an embodiment of the present invention.

1 speaker
2 magnetic circuit unit
3 vibrating unit
4 frame
12 voice coil
14 drive cone
15 diaphragm
28 hole (one hole)
34 positioning member
35 fuse
37 lead wire (connecting wire)
38 tube member
K space

BEST MODE FOR CARRYING OUT THE INVENTION

Hereafter, an embodiment according to the present invention will be explained. In a speaker according to the embodiment of the present invention, all of a plurality of connecting wires are passed through an inside of a tube member, and the tube member is pressed into a hole penetrating a frame to guide the connecting wires to an outside of the frame. Thus, because only one hole is formed on the frame, and all of the connecting wires are bound with only one tube member, a space surrounded by the frame, a drive cone, and a diaphragm is surely sealed. Therefore, an air in the space surrounded by the drive cone, the diaphragm, and the frame is prevented from leaking to the outside, and the connecting wire electrically connected to the voice coil can be surely guided to the outside.

Further, the speaker may include a plurality of voice coils wound on a single voice coil bobbin and may include at least four connecting wires. In this case, because the voice coils can be connected in series or in parallel, the speaker can be adapted to various amplifiers.

Further, it is desirable that the connecting wires are separated from each other in a circumferential direction. In this case, force acting on the diaphragm by the connecting wires is even in the circumferential direction, and the connecting wires are prevented from exerting a bad influence on the vibration of the diaphragm.

Further, the speaker may include a positioning member for aligning the connecting wires on an inner peripheral wall of the frame. In this case, even if the connecting wires are separated from each other in the circumferential direction, the connecting wires can be surely guided to a hole.

Further, a fuse may be attached to the positioning member. In this case, the fuse is positioned in an enclosed space, the melting fuse is prevented from scattering to an outside of the enclosed space.

Embodiment

An embodiment of the present invention will be explained with reference to FIGS. 1 to 3. A speaker 1 according to the embodiment of the present invention shown in FIG. 1 is mounted on a vehicle of a moving object to provide voice information to crews in the vehicle.

As shown in FIG. 1, the speaker 1 includes: a frame 4; a magnetic circuit unit 2; a vibrating unit 3 for generating sound; and a wiring structure unit 5.

As shown in FIG. 1, the frame 4 includes: a frame main body 20; a frame for connector 21; a cover for the magnetic circuit unit 22; and a gasket 23.

The frame main body 20 is made of metal such as aluminum. The frame main body 20 includes: an annular bottom part 24; a cylinder part 25 extending upward from a periphery of the bottom part 24; and a flange part 26 projecting from an inner wall (inner side wall, inner peripheral wall) of the cylinder part 25. An opening 27 penetrating the cylinder part 25, namely, the frame main body 20 is formed at an end of the cylinder part 25 near the bottom part 24. A plurality of openings 27 (not shown) are formed on the bottom part 24 and the cylinder part 25 of the frame main body 20, and separated from each other in the circumferential direction.

The flange part 26 is formed in an annular shape and projected toward an inside of the cylinder part 25 from the inner wall of the cylinder part 25. The flange part 26 is extended in the whole circumference of the cylinder part 25 along the inner all of the cylinder part 25. Further, a single hole 28 into which a later-described tube member 38 is pressed is provide on the flange part 26. Of course, the hole 28 penetrates the frame main body 20, namely, the flange part 26 of the frame 4.

The frame for connector 21 is attached to the frame main body 20 so as to close one of the above-described openings 27 on the frame main body 20. A connector 29 for connecting to the above-described amplifier mounted on a vehicle is attached to the frame for connector 21. The connector 29 may be connected to not only the amplifier but also other electronic components.

The cover for the magnetic circuit unit 22 includes an annular bottom part 30, and a cylinder part 31 extending upward from a periphery of the bottom part 30. The cover for the magnetic circuit unit 22 is fixed to a later-described yoke 7 of a magnetic circuit unit 2 with a bolt 32. A plate 9 and the frame main body 20 are fixed with a bolt 33. When the cover for the magnetic circuit unit 22 is fixed to the frame main body 20, the cover for the magnetic circuit unit 22 is made coaxial with the frame main body 20. Here, "coaxial" means that center axes of the cover for the magnetic circuit unit 22 and the frame main body 20 are substantially the same.

A gasket 23 is formed in an annular shape. The gasket 23 is overlapped with a periphery (outer circumference) of the frame main body 20, and sandwiches a later-described edge 18 with the periphery, and then, fixed to the frame main body 20 with such as an adhesive agent. The gasket 23 and the periphery of the frame main body 20 sandwiches the edge 18 so as to fix a later-described diaphragm 15 with respect to the frame main body 20.

The magnetic circuit unit 2 is attached to the frame 4 by means that the magnetic circuit unit 2 is fixed to both the cover for the magnetic circuit unit 22 and the frame main body 20. As shown in FIG. 1, the magnetic circuit unit 2 includes: the yoke 7 made of magnetic material (so-called paramagnetic material or ferromagnetic material); a magnet 8; and the plate made of magnetic material (so-called paramagnetic material or ferromagnetic material). The yoke 7 is an external magnet type magnetic circuit integrally including: an annular bottom plate 10; and a cylindrical center pole 11 extending from a center inner edge of the bottom plate 10. In this embodiment, the external magnet type magnetic circuit is disclosed. However, according to the present invention, an internal magnet type magnetic circuit or a magnetic circuit using both the internal magnet and the external magnet (magnetic circuit having magnets both inside and outside of the voice coil bobbin) can be used. Further, according to this embodiment, an opening communicating with an outside of the speaker is provided on the center pole 11. However, according to the present invention, it is acceptable that the opening may not be provided.

The magnet 8 is formed in an annular shape. An inner diameter of the magnet 8 is larger than an outer diameter of the center pole 11. The magnet 8 is overlapped with the bottom plate 10 while the center pole 11 is disposed in an inside of the magnet 8. The above-described magnet 8 may be a magnet excited by a permanent magnet or by a DC power source.

The plate 9 is formed in an annular shape. An inner diameter of the plate 9 is larger than the outer diameter of the center pole 11. The plate 9 is overlapped with the magnet 8 while the center pole 11 of the yoke 7 and a later-described voice coil bobbin 13 are disposed in an inside of the plate 9. The yoke 7, the magnet 8, and the plate 9 are arranged coaxially to each other, namely, the center axes thereof are arranged substantially the same. Therefore, inner circumferential walls of the magnet 8 and the plate 9 are separated from an outer circumferential wall of the center pole 11 of the yoke 7.

Further, the above-described yoke 7 is fixed to the cover for the magnetic circuit unit 22 with the bolt 32 penetrating the cylindrical bottom part 30 and the bottom plate 10. Further, The bolt 33 penetrating the bottom part 24 of the frame main body 20 is screwed into the plate 9 to fix the plate 9 to the frame main body 20. Thus, the magnetic circuit unit 2 is fixed to the frame 4 by means that the plate 9 is fixed to the frame main body 20, and the bottom plate 10 is fixed to the cover for the magnetic circuit unit 22. Of course, the yoke 7, the magnet 8, and the plate 9 are arranged coaxial with the frame 4.

According to the above-described structure, in the magnetic circuit unit 2, a magnetic gap G having a large magnetic flux density is formed between the outer peripheral wall of the center pole 11 of the yoke 7 and the inner peripheral wall of the plate 9. Namely, in the magnetic gap G, the magnetic circuit unit 2 applies the electromagnetic force (Lorentz force) to a voice coil 12 to vibrate the diaphragm 15.

The vibrating unit 3 is received in the frame main body 20 of the frame 4. The vibrating unit 3 includes the voice coil 12, the voice coil bobbin 13, a drive cone 14, the diaphragm 15, and a center cap 16. In this embodiment, two voice coils are provided, and two voice coil bobbins 13 are wound integrally (not shown). Further, before the diaphragm 15 is vibrated, the voice coils are arranged coaxial to each other, and disposed in the above-described magnetic gap G of the magnetic circuit unit 2. Voice currents are supplied to the voice coil 12.

The voice coil bobbin 13 is formed in a cylinder shape. An inner diameter of the voice coil bobbin 13 is larger than the outer diameter of the center pole 11 of the yoke 7. An outer diameter of the voice coil bobbin 13 is smaller than the inner diameters of the plate 9 and the magnet 8. The voice coil bobbin 13 is arranged coaxial with the yoke 7, the plate 9, and the voice coil 12. One end of the voice coil bobbin 13 is inserted into the magnetic gap G, and the voice coil 12 is attached to the periphery of the one end of the voice coil bobbin 13. The voice coil bobbin 13 is movably supported along the center axis of the yoke 7 by the drive cone 14 and the diaphragm 15. The center axes of the yoke 7 and the speaker 1 are substantially the same.

The drive cone 14 transmits the vibration of the voice coil 12 to the later-described diaphragm 15. The drive cone 14 is made of resin or the like. The drive cone 14 is formed in an annular shape, and an inner edge thereof is attached to an outer wall of the other end of the voice coil bobbin 13 in the center axis direction. Therefore, the drive cone 14 is attached to the voice coil 12 via the voice coil bobbin 13. An annular thin plate shaped elastically deformable edge 17 is attached to an outer edge of the drive cone 14 with the adhesive agent or the like. A commonly known method such as threading or sewing can be used instead of the adhesive agent for joining the edge 17 and the drive cone 14. An outer edge of the edge 17 is sandwiched between the flange part 26 of the frame main body 20 and a later-described positioning member 34 of the wiring structure unit 5, and thus, the edge 17 is fixed to these. Namely, the drive cone 14 is attached to the frame main body 20, namely, the frame 4 via the edge 17.

The diaphragm 15 is made of resin or the like. The diaphragm 15 is formed in an annular shape. An inner diameter of the diaphragm 15 is larger than an inner diameter of the drive cone 14, and an outer diameter of the diaphragm 15 is larger than an outer diameter of the drive cone 14. The diaphragm 15 is fixed to a part of the drive cone 14, in particular, grooves thereof indicated by reference numbers 47, 48, 49 in FIG. 1 with the adhesive agent or the like. The thin plate shaped edge 18 having a semi-circular section is attached to the outer edge of the diaphragm 15 with the adhesive agent or the like. An outer edge of the edge 18 is sandwiched between an outer edge of the cylinder part 25 of the frame main body 20 and the gasket 23, and thus, the edge 18 is fixed to these. Namely, the diaphragm 15 is attached to the frame main body 20, namely, the frame 4 via the edge 18.

The center cap 16 is made of resin or the like. The center cap 16 is circular. A sectional shape of the center cap 16 is a convex shape in the center thereof in a sound emission direction, and a concave shape from the center toward an outer edge thereof. An outer diameter of the center cap 16 is larger than the inner diameter of the drive cone 14, and is smaller than the outer diameter of the diaphragm 15. An outer edge of the center cap 16 is overlapped with the diaphragm 15, and attached to the diaphragm 15 along a whole periphery with the adhesive agent or the like.

The above-described drive cone 14, the diaphragm 15, and the center cap 16 of the vibrating unit 3 are, of course, arranged coaxial to the frame 4 and the magnetic circuit unit 2. In the vibrating unit 3, when the voice currents corresponding to voice data is supplied to the voice coil 12, the drive cone 14 transmits the vibration of the voice coil 12 to the diaphragm 15, and the diaphragm 15 vibrates along the above-described center axis to generate sound corresponding to the voice currents.

Further, a space K surrounded by the above-described drive cone 14, the diaphragm 15, the edges 17, 18, and an inner wall of the frame 4 of the frame main body 20 is sealed. Namely, the space K surrounded by the drive cone 14, the diaphragm 15, the edges 17, 18, and the inner walls of the frame 4 of the frame main body 20 is hermetically-closed.

Therefore, in the above-described vibrating unit 3, when the voice coil bobbin 13 vibrates along the center axis, and the drive cone 14 and the diaphragm 15 vibrates, because an air in the space K between the drive cone 14 and the diaphragm 15 is repeatedly compressed and expanded due to displacement of the drive cone 14 and the diaphragm 15 and displacement of the edges 17, 18, a spring characteristic as an air spring is developed.

In this embodiment, when an effective area of the diaphragm 15 is S1, an effective area of the drive cone 14 is S2, the difference S is expressed by S=S1−S2. Further, when a volume of the air in the sealed space K between the drive cone 14 and the diaphragm 15 is V, a stiffness constant indicating the spring characteristic of the air spring is proportional to S/V. Namely, in this embodiment, the spring characteristic as the air spring occurs based on the air in the sealed space K between the drive cone 14 and the diaphragm 15 allows to regulate an abnormal behavior such that the diaphragm 15 vibrates in very large amplitude, to reproduce a sound characteristic of the speaker 1 for a long time, and to maintain reliability of the speaker 1 even when the diaphragm 15 vibrates in large amplitude for a long time.

Figure 2:
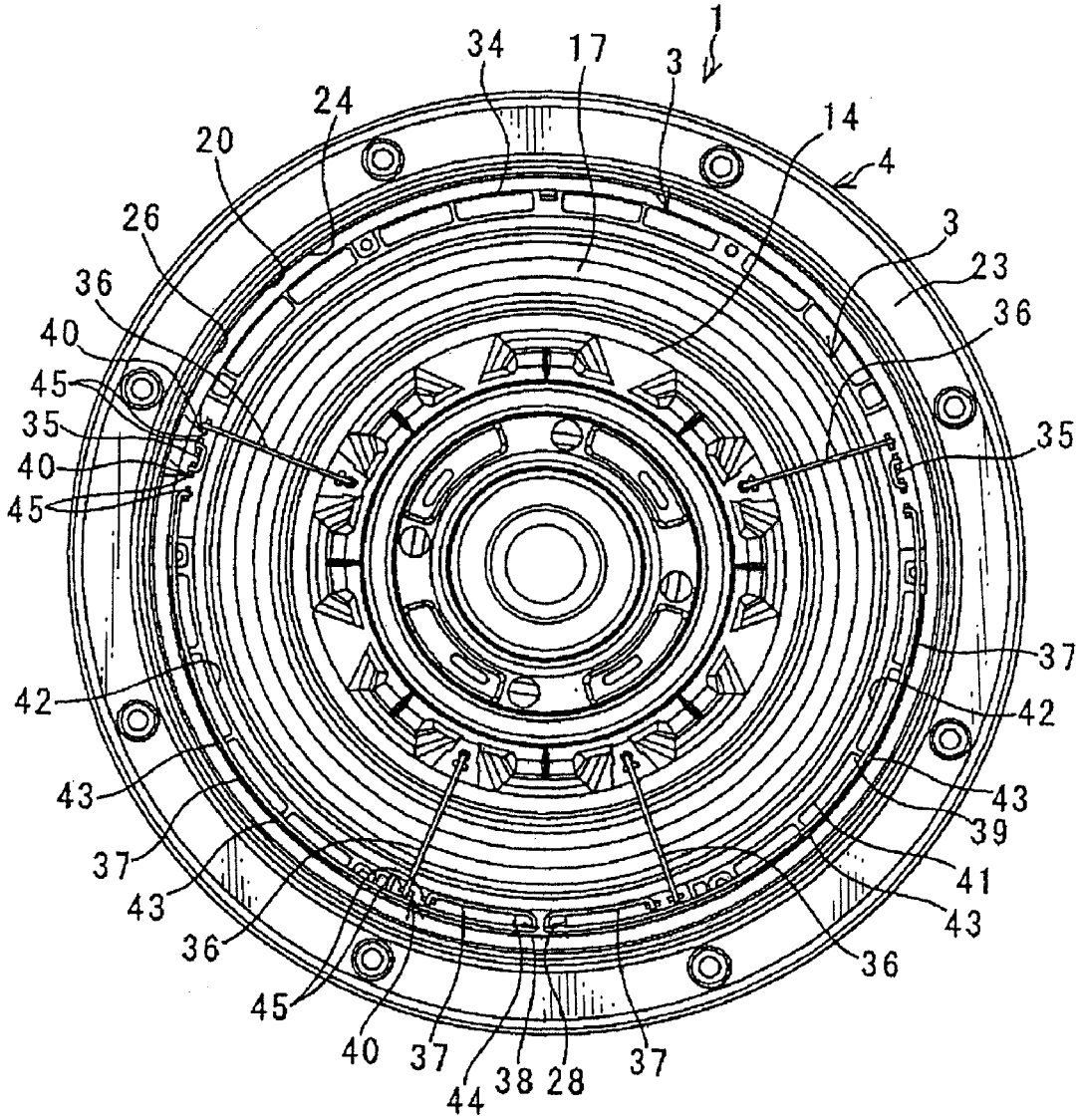

As shown in FIG. 2, the wiring structure unit 5 includes: the positioning member 34; a fuse 35; a plurality of tinsel wires 36, a plurality of lead wires 37 as the connecting wires; and a tube member 38. As shown in FIG. 3, the positioning member 34 includes: a member main body 39; and a press contact terminal 40 of which a part is insert-molded in the member main body 39. The member main body 39 is formed in an annular shape, and an outer diameter of the member main body 39 is substantially the same as an inner diameter of the cylinder part 25 of the frame main body 20. The member main body 39 includes: a base plate part 41 stacked on the flange part 26; a plurality of inner wall parts 42 extending upward from an inner edge of the base plate part 41 and separated from each other in a circumferential direction; and a plurality of positioning pins 43 extending upward from the center in a radial direction and separated from each other in the circumferential direction.

In the member main body 39, namely, the positioning member 34, the base plate part 41 is coaxial to the flange part 26, sandwiches an outer edge of the edge 17 with the flange part 26, and is fixed to the flange part 26, namely, the frame main body 20 with a not-shown bolt, the adhesive agent, or the like. Therefore, the member main body 39, namely, the positioning member 34 is disposed in the above-described space K. The inner wall parts 42 and the positioning pins 43 sandwich the lead wires 37 therebetween, and position the lead wires 37 along an inner wall of the cylinder part 25 of the frame main body 20 of the frame 4. Namely, the positioning member 34 positions the lead wires 37 along the inner wall of the cylinder part 25 of the frame main body 20 of the frame 4. Further, as shown in FIG. 3, a cutout 44 is formed on the member main body 39, and the cutout 44 is overlapped with the hole 28 when the member main body 39 is attached to the flange part 26.

The press contact terminal 40 is made of conductive plate metal or the like, and integrally includes a pair of press contact blades 45 extending upward from the member main body 39; and a not-shown connecting part connecting the press contact blades to each other and embedded in the member main body 39. The tinsel wires 36 or the lead wires 37 are pressed into the press contact blades 45 of the press contact terminal 40.

Figure 3:
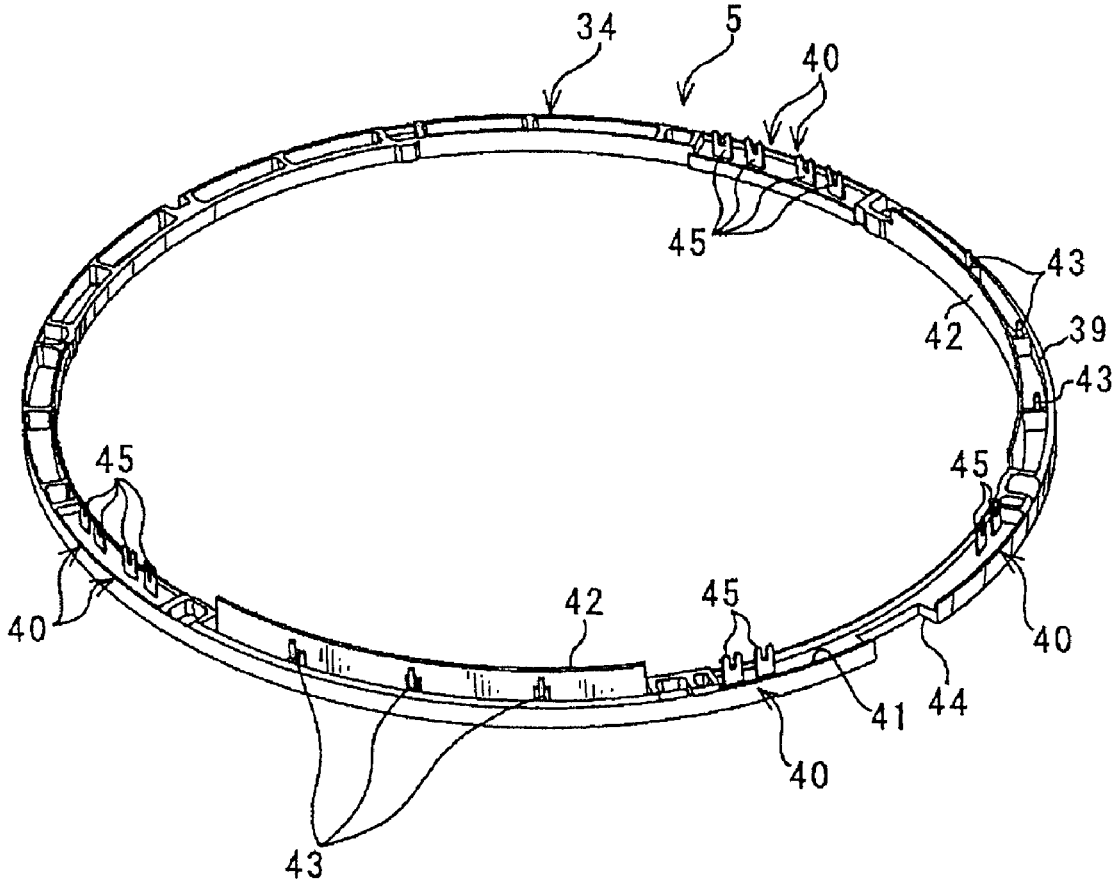
FIG. 3 A perspective view showing a positioning member of the speaker shown in FIG. 1.

According to the embodiment shown in FIG. 3, six press contact terminals are formed, and separated from each other in a circumferential direction of the member main body 39. When the positioning member 34 is fixed to the frame 4, two of the press contact terminals 40 are disposed near the hole 28, and the other four are disposed away from the hole 28.

According to the embodiment shown in FIG. 2, two fuses 35 are provided. As shown in FIG. 2, the fuses 35 are respectively pressed into the press contact blades 45 of the press contact terminals 40 adjacent to each other and disposed away from the hole 28 to connect the press contact terminals 40 to each other. Thus, the fuses 35 are disposed in the above-described space K. The fuses 35 are connected to the lead wires 37 and the tinsel wires 36 in series. When the voice current supplied to the voice coil 12 is larger than a predetermined current value, the fuses 35 melt down to stop supplying the voice current to the voice coil 12.

According to the embodiment shown in FIG. 2, four tinsel wires 36 are provided. One end of each tinsel wire 36 penetrates the drive cone 14, and is connected to the voice coil 12. The tinsel wires 36 are separated from each other in the circumferential direction, and guided out toward the positioning member 34 (namely, in the space K) in a radial direction of the speaker 1 from the outer wall of the voice coil bobbin 13. Two of the tinsel wires 36 are pressed into the press contact blades 45 disposed further away from the hole 28 of the press contact terminals 40 disposed further away from the hole 28 of the four press contact terminals 40 away from the hole to be connected to the press contact terminals 40. The other two tinsel wires 36 are pressed into the press contact blades 45 away from the hole 28 of the two press contact terminals 40 near the hole 28 to be connected to the press contact terminals 40.

The lead wire 37 is a so-called covered wire having a conductive core wire and an insulating cover. According to the embodiment shown in FIG. 2, four lead wires 37 are provided. Two of the lead wires 37 are pressed into the press contact blades 45 near the hole 28 of the press contact terminals 40 nearer the hole 28 of the four press contact terminals 40 disposed away from the hole 28 to be connected to the press contact terminals 40. The other two lead wires 37 are pressed into the press contact blades 45 near the hole 28 of the press contact terminals 40 disposed near the hole 28 to be connected to the press contact terminals 40.

Thus, the lead wires 37 are connected to the voice coil 12 via the press contact terminals 40 and the tinsel wires 36. While the lead wires 37 are positioned by being sandwiched between the inner wall parts 42 and the positioning pins 43, the lead wires 37 are wired from the press contact blades 45 to the cutout 44, namely, the hole 28. The lead wires 37 supply the voice current to the voice coil 12.

The tube member 38 is made of rubber, and formed in a tubular shape. The tube member 38 may be made of resin or the like other than rubber. The tube member 38 is so shaped that the rubber surrounds each of four lead wires 37 by insert molding. While all of the four lead wires 37 are inserted into an inside of the tube member 38 and tied up, the tube member 38 is pressed into the hole 28 to be attached to the frame main body 20, namely, the frame 4. All of the four lead wires 37 are inserted into an inside of the tube member 38, and the tube member 38 guides the four lead wires 37 to an outside of the space K. Then, the lead wires 37 are attached to a terminal 46 of the connector 29 at the outside of the space K. Further, when the drive cone 14 and the diaphragm 15 vibrate, the tube member 38 keeps the space K sealed so that the air in the space K may not leak via the hole 28. Further, as described the above, it is preferable that the tube member 38 is made of elastic rubber for keeping the space K sealed.

The above-described wiring structure unit 5 is assembled by pressing the fuses 35, the tinsel wires 36, and the lead wires 37 into the desired press contact blades 45, by pressing the tube member 38 into which all of the four lead wires 37 are inserted into the hole 28, and by attaching the lead wires 37 into the terminal 46 of the connector 29. Then, by connecting sequentially the lead wires 37, the fuses 35, the tinsel wires 36, and the voice coil 12 in series, the wiring structure unit 5 supplies the voice currents supplied to the terminal 46 of the connector 29 to the voice coil 12.

According to the speaker 1 having the above-described structure, the voice currents are supplied to the voice coil 12 via the lead wires 37 in the wiring structure unit 5, and the voice coil 12 disposed in the magnetic gap G vibrates along the center axis corresponding to the voice currents. Then, the voice coil bobbin 13 wounded around the periphery of the voice coil 12, the drive cone 14, and the diaphragm 15 vibrates along the center axis. Namely, the vibration of the voice coil 12 is transmitted to the diaphragm 15 via the drive cone 14, and the diaphragm 15 vibrates to generate sound corresponding to the voice currents.

According to this embodiment, all of the lead wires 37 are guided to the outside of the space K by inserting all of the lead wires 37 into the tube member 38, and by pressing the tube member 38 into the hole 28 penetrating the frame 4. Thus, because only one hole 28 is formed on the frame 4, and all of the lead wires 37 are bundled together by one tube member 38, the space K surrounded by the frame 4, two drive cones 14, and the diaphragm 15 is surely sealed. Therefore, the lead wires 37 connected to the voice coil 12 are surely guided to the outside of the space K, while when the drive cone 14 and the diaphragm 15 vibrates, the air in the space K surrounded by the drive cone 14, the diaphragm 15, and the frame 4 is prevented from leak outside.

Further, the speaker 1 includes two voice coils 12 and four lead wires 37. Therefore, because two voice coils can be connected in series or in parallel, the speaker 1 can be adapted to various amplifiers.

Further, because a plurality of lead wires 37 are separated from each other in the circumferential direction, the diaphragm 15 can be balanced in weight, and the lead wires 37 are prevented from exerting a bad influence on the vibration of the diaphragm 15. According to the present invention, it is more desirable for balancing the diaphragm 15 in weight that the lead wires 37 are equally separated from each other in the circumferential direction.

Further, the speaker 1 includes the positioning member 34 for positioning the lead wires 37 along the inner wall of the cylinder part 25 of the frame main body 20 of the frame 4. Therefore, even when the lead wires 37 are separated from each other in the circumferential direction, the lead wires 37 can be surely guided to the single hole 28.

Further, the fuse 35 is attached to the positioning member 34. Therefore, the fuse 35 is positioned in the enclosed space K, the melting fuse 35 is prevented from scattering to the outside of the space K. Further, the positioning member 34 positions the lead wires 37 as the connecting wires along the inner wall of the cylinder part 25 of the frame main body 20. Therefore, when the drive cone 14 and the diaphragm 15 vibrate, the lead wires 37 also vibrate to suppress unnecessary vibration and sound wave. Further, it is possible to prevent the unnecessary vibration from transmitting to the drive cone and the diaphragm.

Further, in the speaker 1, the spring characteristic as the air spring, which the air in the sealed space K between the drive cone 14 and the diaphragm 15 provides, absorbs vibrating energy of the voice coil bobbin 13, the drive cone 14, and the diaphragm 15 to attenuate the vibration of the drive cone 14, the diaphragm 15, and the voice coil bobbin 13. Therefore, it is unnecessary to provide a damper as the conventional speaker includes. Namely, in the speaker 1 according to this embodiment, the drive cone 14 and the diaphragm 15 themselves work as the damper to attenuate the vibration of the drive cone 14, the diaphragm 15, and the voice coil bobbin 13. Therefore, it is unnecessary to equip the damper for supporting the voice coil bobbin 13 at a back side of the drive cone 14 and the diaphragm 15. Therefore, a size of the speaker 1 in the axis direction can be reduced by omitting the damper and a space for installing the damper, and a slim speaker 1 required by an audio system mounted on a vehicle can be realized.

Further, the drive cone 14 is disposed coaxially at a back side of the diaphragm 15 for realizing the sealed space K between the drive cone 14 and the diaphragm 15. This drive cone 14 may be made of the same material as the diaphragm 15. When comparing with a conventional corrugation damper, mechanical fatigue is less likely to occur. Therefore, reliability reduction of the speaker 1 caused by the mechanical fatigue of the components is prevented, and the life time of the speaker 1 can be increased.

Further, the corrugation damper is deformed perpendicular to the center axis of the voice coil to prevent the vibrating unit, namely, the voice coil, the voice coil bobbin, the diaphragm, or the like from oscillating horizontally (perpendicular to the center axis of the voice coil). However, in this speaker 1, the drive cone 14 and the diaphragm 15 are not locally and largely deformed. Therefore, abnormal vibration such as seen in a rolling phenomenon to spoil sound quality and sibilating sound generated when the voice coil bobbin 13 contacts the plate 9 or the magnet 8 are not generated, and high quality clear sound can be reproduced.

In the speaker 1 according to this embodiment, when the diaphragm 15 vibrates, the air in the sealed space K between the drive cone 14 and the diaphragm 15 is repeatedly compressed and expanded. Therefore, the edges 17, 18 of the drive cone 14 and the diaphragm 15 are less likely to be deformed due to air pressure (back pressure) received at the back side. Therefore, without generating the abnormal vibration or the sibilating sound, the drive cone 14 and the diaphragm 15 can vibrate with large amplitude, and loud sound can be reproduced. Further, owing to the drive cone 14 and the edge 17, it becomes possible that the air spring developed by the air in the space K prevents abnormal behavior of the diaphragm 15 vibrating with very large amplitude, that the acoustic characteristic of the speaker 1 is reproduced continuously, that the acoustic characteristic of the speaker 1 is reproduced for a long time, and that reliability of the speaker 1 is maintained even when the diaphragm 15 vibrates with large amplitude for a long time.

In the above-described embodiment, two voice coils 12, four tinsel wires 36, and four lead wires 37 are provided. However, according to the present invention, one or more than two voice coils 12 and two or more than three tinsel wires 36 and the lead wires 37 can be provided.

According to the above-described embodiment, the speaker described below is obtained.

(Note) A speaker 1 comprising:

a frame 4;

a magnetic circuit unit 2 attached to the frame 4;

a vibrating unit 3 received in the frame 4 and having a voice coil 12 to which voice currents are supplied, a diaphragm 15, and a drive cone 14 for transmitting a vibration of the voice coil 12 to the diaphragm 15;

a sealed space K surrounded by the frame 4, the drive cone 14, and the diaphragm 15;

a plurality of connecting wires 37 for connecting to the voice coil 12 and supplying the voice currents to the voice coil 12; and the connecting wires are wired in the space;

a tube member 38 for sealing the space K and for binding all of the connecting wires 37 through an inside thereof, and guiding all of the connecting wires 37 to an outside of the space K by being pressed into a hole 28 penetrating the frame 4.

According to the Note, all of the lead wires 37 are inserted into the tube 38, and the tube 38 is pressed into the hole 28 penetrating the frame 4 to guide the lead wires 37 to the outside of the space K. Thus, because only one hole 28 is formed on the frame 4, and only one tube member 38 binds all of the tube member 38, the space K surrounded by the frame 4, the drive cone 14, and the diaphragm 15 is surely sealed. Therefore, the air in the space K surrounded by the frame 4, the drive cone 14, and the diaphragm 15 is prevented from leaking outside, and the lead wires 37 connected to the voice coil 12 are surely guided to the outside of the space K.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A speaker comprising:

a frame;

a magnetic circuit unit supported by the frame;

a voice coil received in the frame, and to which voice currents are supplied;

a diaphragm connected to the frame; and a drive cone for transmitting a vibration of the voice coil to the diaphragm, wherein the voice coil is connected to an inner edge of the drive cone, wherein the diaphragm is connected to a part of the drive cone arranged between the inner edge of the drive cone and an outer edge of the drive cone, wherein the frame has a flange projecting from an inner wall thereof, wherein the outer edge of the drive cone is connected to the flange, wherein a sealed space surrounded by the frame, the diaphragm, and the drive cone is provided, wherein connecting wires electrically connected to the voice coil are inserted into a hole formed on the flange, and wherein a tube member into which the connecting wires are inserted is disposed into the hole.

2. The speaker as claimed in claim 1, wherein the connecting wires are wired to a bottom side of the flange in an interior of the frame.

3. The speaker as claimed in claim 2, wherein a terminal is provided on the inner wall of the frame at the bottom side of the flange, and wherein the connecting wires are electrically connected to the terminal.

4. The speaker as claimed in claim 3, wherein a connector is provided on an outer wall of the frame at the bottom side of the terminal, and the connector includes the terminal.

5. The speaker as claimed in claim 4, wherein one ends of tinsel wires, which are electrically connected to the connecting wires, connected to the voice coil are passed through the drive cone.

6. The speaker as claimed in claim 2, further comprising a plurality of edges, wherein the diaphragm and the drive cone are supported by the frame via the edges.

7. The speaker as claimed in claim 1, further comprising a plurality of connecting wires, wherein the connecting wires are passed through an interior of the tube member.

8. The speaker as claimed in claim 1, further comprising:

a plurality of voice coils; and at least four connecting wires.

9. The speaker as claimed in claim 1, wherein the connecting wires are separated from each other in a circumferential direction and guided out to the sealed space from a voice coil bobbin of a vibrating unit.

10. The speaker 1 as claimed in claim 1, further comprising:

a circular positioning member disposed in the space along the inner wall of the frame, wherein the positioning member positions the connecting wires along an inner circumferential wall of the frame.

11. The speaker as claimed in claim 10, wherein a fuse which melts down when electric current supplied to the voice coil is more than a predetermined current value is attached to the positioning member.

12. The speaker as claimed in claim 10, further comprising an edge for supporting the drive cone on the frame, wherein the positioning member sandwiches the edge with the flange of the frame.

13. The speaker as claimed in claim 10, wherein the positioning member includes: a member main body attached to the flange of the frame; and a terminal to which the connecting wires are attached.

14. The speaker as claimed in claim 13, wherein the member main body includes a base plate, a wall part, and a positioning pin.

15. The speaker as claimed in claim 14, wherein the member main body includes a plurality of positioning pins, and wherein the connecting wires are attached in between the positioning pins.

16. The speaker as claimed in claim 15, wherein a cutout is formed on the member main body at a position corresponding to the hole on the flange.

17. The speaker as claimed in claim 13, wherein the positioning member includes a plurality of terminals.

18. A speaker comprising:

a frame;

a magnetic circuit unit supported by the frame;

a voice coil received in the frame, and to which voice currents are supplied;

a diaphragm connected to the frame; and a drive cone for transmitting a vibration of the voice coil to the diaphragm, wherein the voice coil is connected to an inner edge of the drive cone, wherein the diaphragm is connected to a part of the drive cone arranged between the inner edge of the drive cone and an outer edge of the drive cone, wherein the frame is connected to the outer edge of the drive cone, wherein a sealed space surrounded by the frame, the diaphragm, and the drive cone is provided, wherein an annular positioning member is positioned in the sealed space along an inner wall of the frame, wherein the positioning member supports connecting wires electrically connected to the voice coil;

wherein a cutout is formed on the positioning member corresponding to a hole formed on the frame for communicating with an outside;

wherein the connecting wires pass through the cutout of the positioning member; and wherein a tube member into which the connecting wires are inserted is disposed on the cutout.

19. A vehicle comprising the speaker as claimed in claim 1 or claim 18.

* * * * *